US008033834B2

(12) United States Patent
Polnyi et al.

(10) Patent No.: US 8,033,834 B2
(45) Date of Patent: Oct. 11, 2011

(54) ELECTRICAL CONNECTOR TERMINAL WITH TWISTED ARM

(75) Inventors: Igor Polnyi, Aurora, IL (US); Chi-Nan Liao, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 1122 days.

(21) Appl. No.: 11/648,470

(22) Filed: Dec. 28, 2006

(65) Prior Publication Data

US 2008/0160842 A1 Jul. 3, 2008

(51) Int. Cl.
*H01R 12/00* (2006.01)

(52) U.S. Cl. ..... 439/66

(58) Field of Classification Search ..... 439/66, 439/71, 83, 81, 884, 733.1
See application file for complete search history.

(56) References Cited

U.S. PATENT DOCUMENTS

| | | | | |
|---|---|---|---|---|
| 6,000,975 | A * | 12/1999 | Feldman | 439/857 |
| 6,887,114 | B2 * | 5/2005 | Liao | 439/862 |
| 6,908,313 | B2 * | 6/2005 | Walkup et al. | 439/66 |
| 7,074,048 | B2 * | 7/2006 | Liao et al. | 439/66 |
| 2006/0094308 | A1 * | 5/2006 | Chen | 439/884 |

* cited by examiner

*Primary Examiner* — Tulsidas Patel
*Assistant Examiner* — Vladimir Imas
(74) *Attorney, Agent, or Firm* — Wei Te Chung; Andrew C. Cheng; Ming Chieh Chang

(57) ABSTRACT

An electrical connector terminal (1) includes a base portion (12) having a lower end (122) for connecting to a circuit board and an upper end, a twist portion (14) extending upwardly from the upper end of the base portion, and a contact portion (16) extending upwardly from the twist portion. The contact portion defines an upwardly facing contacting face.

13 Claims, 3 Drawing Sheets

ELECTRICAL CONNECTOR TERMINAL WITH TWISTED ARM

BACKGROUND OF THE INVENTION

1. Field of the Invention

The present invention relates to an electrical connector terminal, and more particularly to a terminal having a twisted portion to reduce the space required for accommodating such a terminal.

2. Background of the Invention

It is known to form an electrical connector terminal for a socket connector by stamping and bending in a desired manner to obtain various configurations. For those terminals having an upwardly projecting arm oriented at an angle relative to a general main plane of the base portion of a contact blank, different designs have been proposed as can be seen in U.S. Pat. Nos. 6,652,329; 6,887,114; 6,929,483; and 6,955,572. These prior designs all exhibit a structural feature that one planar portion of the terminal where the projecting arm is formed is physically connected to another planar portion, usually the base portion of the terminal by a curved section or along a bending line. The two planar portions together with the bending line joining the two portions inevitably increase an overall horizontal dimension of the terminal.

To reduce the above-mentioned horizontal dimension of a terminal, measured in a direction perpendicular to the base portion thereof, while obviating plastic deformation of the projecting arm and/or increase in connection resistance, a design is proposed in U.S. Pat. No. 6,976,888 by making the curved section angled 180 degrees.

On the other hand, twisting a portion of a terminal in consideration of its force/displacement response during mating with another terminal is well known in this art. For example, it is known from U.S. Pat. No. 6,099,326 to twist a lower portion of a terminal which is further soldered to a printed circuit board so that a horizontal displacement of the lower soldered portion can be conditioned. Also, it is known from U.S. Pat. No. 5,035,632 to twist an upper portion of a terminal that then engages from a sideward direction with an inserted card edge.

However, none of the art shows or suggests a terminal which has an upper portion twisted in order to reduce its horizontal dimension.

SUMMARY OF THE INVENTION

An object of the present invention is to provide a terminal comprising a twist portion to reduce its overall profile.

To achieve the above object, a terminal for an electrical connector comprises: a base portion; a twist portion projecting from the base portion; and a contact portion continuing the twist portion and angled relative to the twist portion.

Other objects, advantages and novel features of the invention will become more apparent from the following detailed description when taken in conjunction with the accompanying drawings, in which:

DETAILED DESCRIPTION OF THE PREFERRED EMBODIMENT

Figure 1:
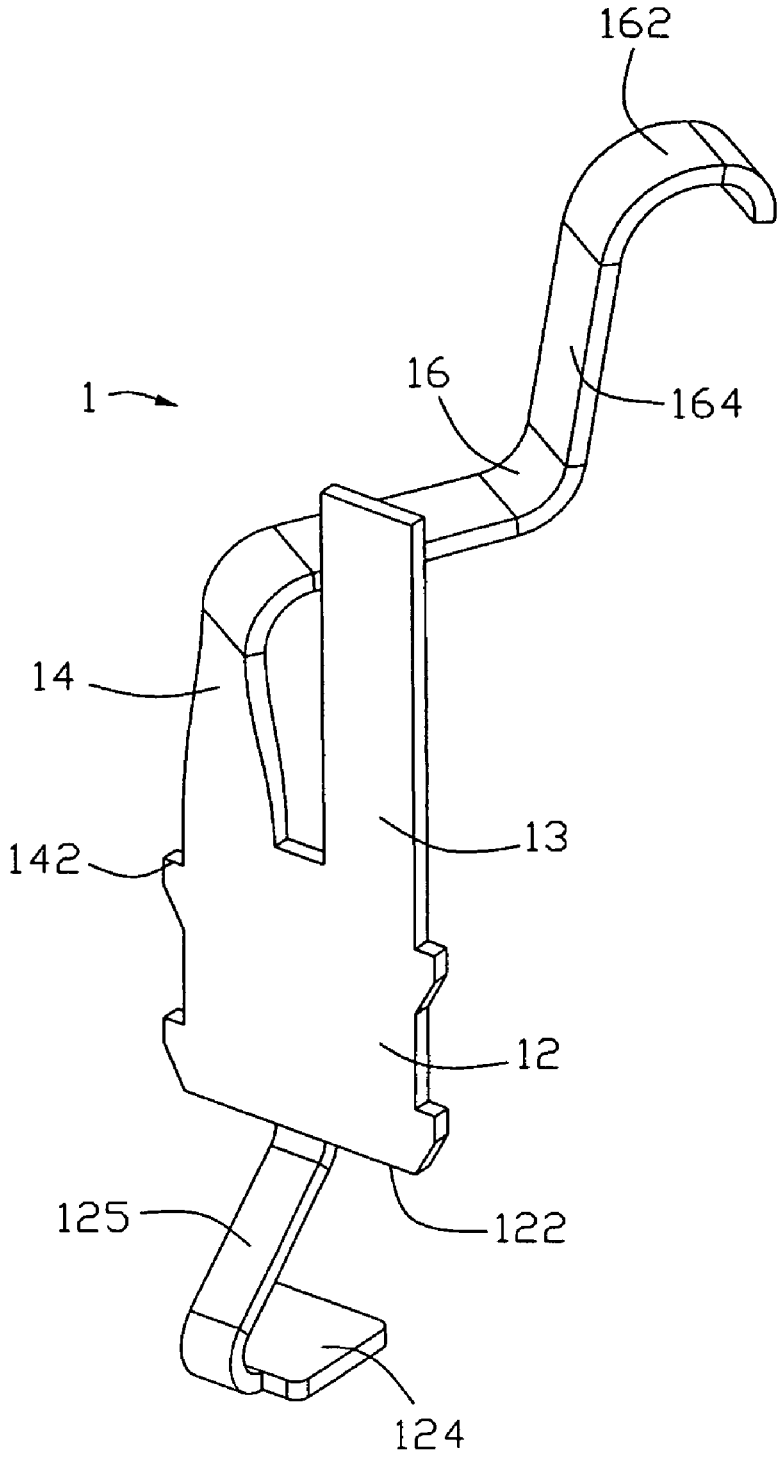
FIG. 1 is a isometric view of a electrical connector terminal in accordance with a preferred embodiment of the present invention.
Figure 2:
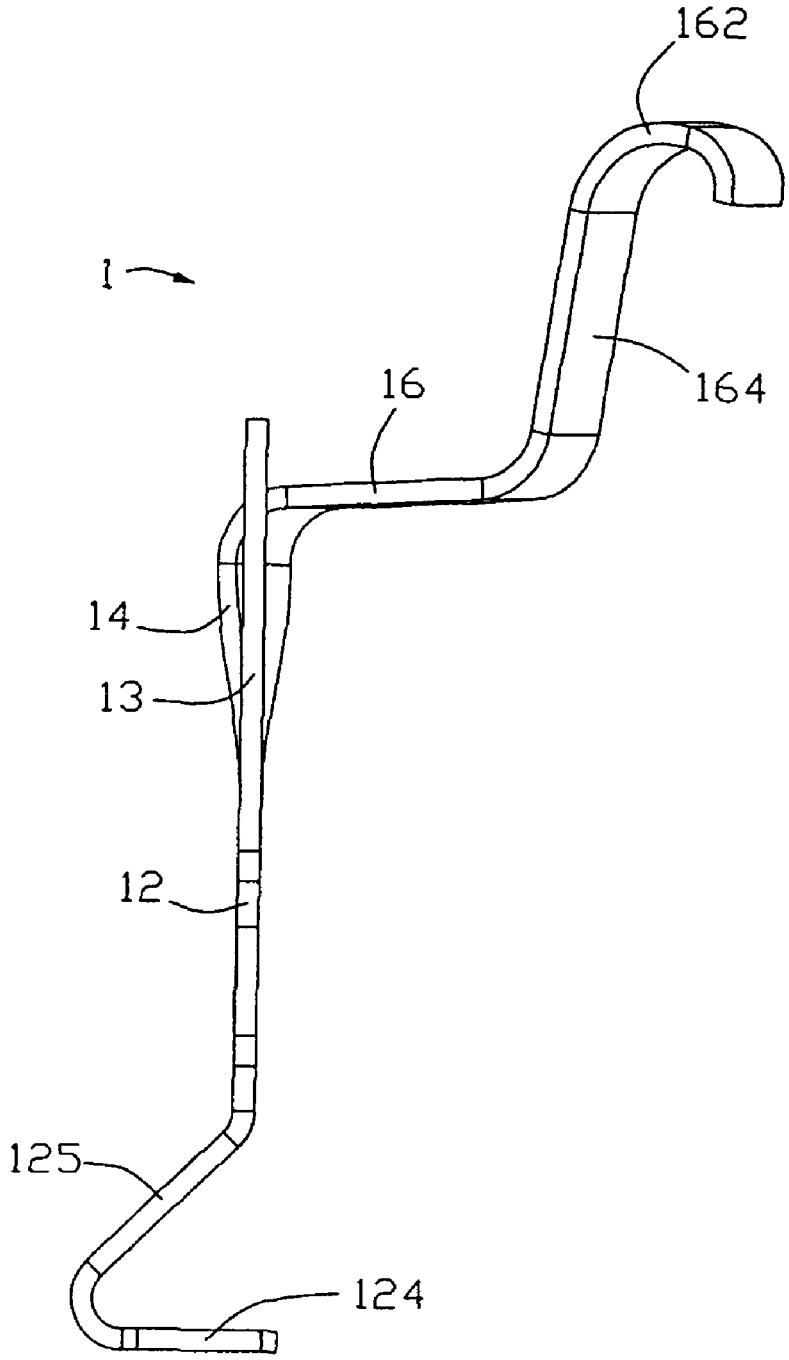
FIG. 2 is side view of the terminal.
Figure 3:
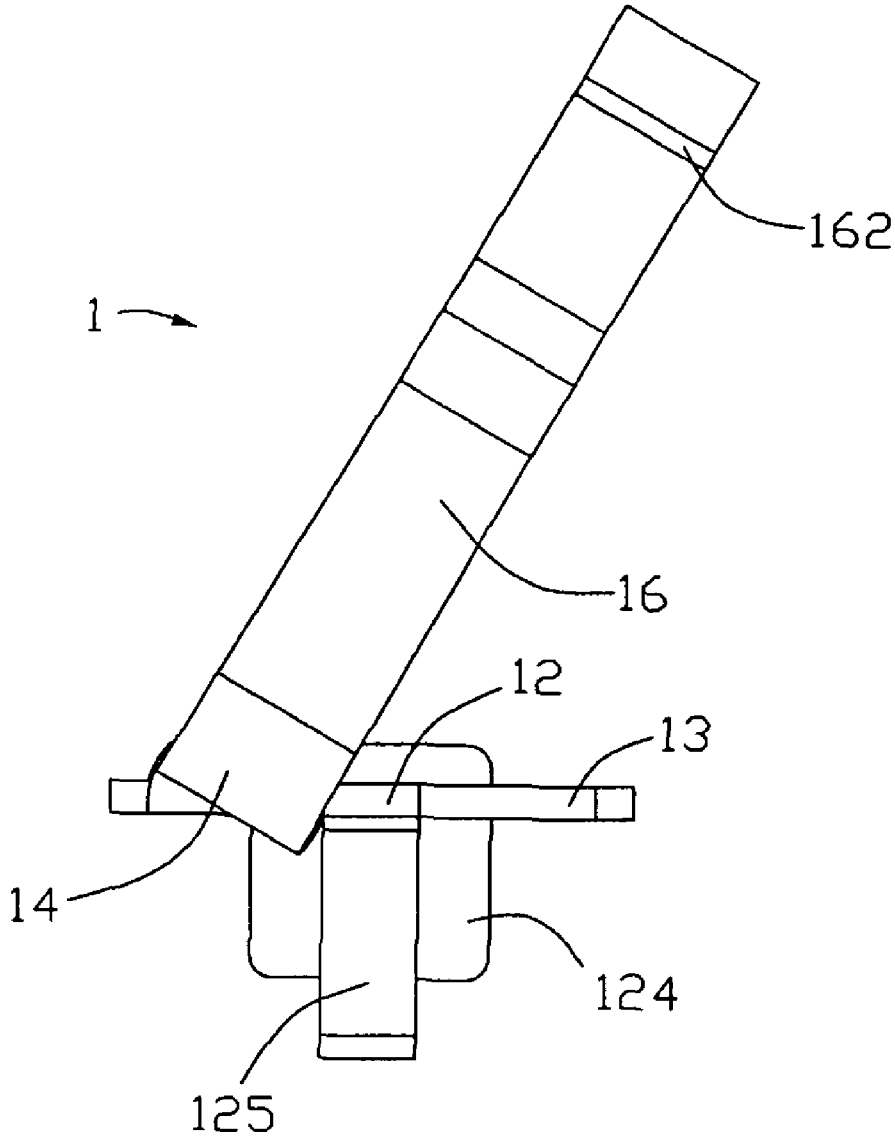
FIG. 3 is a top view of the terminal.

Referring to FIGS. 1 through 3, a terminal 1 for an electrical connector in accordance with the present invention comprises a base portion 12, a twist portion 14 projecting from the base portion 12, and a contact portion 16. The contact portion 16 continues the twist portion 14 and is further angled relative to the twist portion 14. The contact portion 16 is generally profiled to present a curved free end 162, as is well known in this art. In the embodiment shown, the contact portion 16 further has a bent portion 164 to fine tune the contact portion to a desired configuration. It is noted that the contact portion 16 can be formed into various shapes and its detail in this regard forms no part of the claimed invention.

As can be clearly seen in FIG. 1, the twist portion 14 is connected to the base portion 12 along a substantially straight junction line 142. The twist portion 14 thus extends upward from the base portion 12 and is connected thereto along the substantially horizontal junction line 142. As a good example of explanation from FIG. 3, the "twist" portion, therefore, means that this portion, starting from a substantially planar portion, is manipulated or operated to rotate or turn along its vertical axis (in a direction vertical to the drawing sheet of FIG. 3). The angle of twist can be for example 30 degrees.

The base portion 12 may include a tail 124 extending from an lower end 122 for connecting to a circuit board (not shown). In this embodiment, a linking portion 125 is defined between the lower end 122 and the tail 124. The linking portion 125 obliquely and downwardly extends form the lower end. An upper end of the base portion 12 then is where the twist portion 14 extends from upwardly. From the upper end, a positioning member 13 is defined for stably fastening the terminal in a housing 9 not shown), in which the terminal is accommodated. The curved end 162 of the contact portion 16 has an upwardly facing contacting face so that a contacting element or pad of a socket or electronic device can make an electrical connection therewith from above. FIGS. 1 and 3 also clearly shows that the upper end of the base portion 12 spans a width which is substantially greater than twice the width of the twist portion 14. Additionally, the base portion 12 may comprise a retention area such as one or more barbs on one or both side edges thereof so that the terminals 1 can be suitably secured to the housing.

Compared with the prior designs, the twist portion 14 enables to reduce the required space along the direction X shown in FIG. 2. Further, while the curved free end 162 is pressed by the pad, the contact portion is elastically deformed to resist the pressing force, which enables stable electrical connection between the terminal 1 and the pad. Due to the twist portion 14, higher elasticity is accordingly achieved.

While the present invention has been described with reference to a specific embodiment, the description of the invention is illustrative and is not to be construed as limiting the invention. Various of modifications to the present invention can be made to the preferred embodiment by those skilled in the art without departing from the true spirit and scope of the invention as defined by the appended claims.

What is claimed is:

1. A terminal for an electrical connector comprising;

a base portion;

a twist portion extending from the base portion; and a spring arm with a curved end continuing the twist portion and angled relative to the twist portion.

2. The terminal as described in claim 1, wherein the twist portion is connected to the base portion along a substantially straight junction line.

3. The terminal as described in claim 1, wherein the twist portion extends upward from the base portion and is connected along a substantially horizontal junction line to the base portion.

4. The terminal as claimed in claim 1, wherein the base portion is substantially planar and the twist portion lies across a plane defined by the base portion.

5. An electrical connector terminal for electrically connecting an electronic device to a printed circuit board, comprising;

a base portion defining a plurality of barbs;

a twist portion extending continuously from an upper end of the base portion, and a spring arm continuing the twist portion defining a free end for connecting the electronic device; and a tail extending from an lower end of the base portion for connecting the printed circuit board;

a positioning member extending from the upper end of the base portion a long vertical direction: wherein the twist portion rotates about said vertical direction.

6. The electrical connector terminal as described in claim 5, wherein the upper end of the base portion spans a width substantially greater than twice a width of the part of the contact portion.

7. The electrical connector terminal as described in claim 5 further defining a linking portion extends obliquely and downwardly from the lower end of the base to connecting the tail to the lower end.

8. A terminal for an electrical connector comprising:

a base portion defining a first plane;

a spring arm, essentially curvedly extending on a second plane and indirectly extending from the base portion via a twist portion which is arranged between the spring arm and the base portion such that the first plane is in neither parallel nor perpendicular manner with regard to the second plane.

9. The terminal as claimed in claim 8, further including a positioning member extending upwardly from the base in a coplanar manner.

10. The terminal as claimed in claim 9, wherein each of the twist portion and the positioning member is dimensioned only one half of the base in a transverse direction.

11. The terminal as claimed in claim 10, wherein the twist portion, is lower than the positioning member.

12. The terminal as claimed in claim 8, wherein the twist portion twists about an axis extending in a vertical direction.

13. The terminal as claimed in claim 12, wherein said axis lies in the first plane.

* * * * *